United States Patent [19]

Wirtgen

[11] 4,172,679

[45] Oct. 30, 1979

[54] DEVICE FOR RENEWING ROAD SURFACES.

[76] Inventor: Reinhard Wirtgen, Hohner Strasse, 5461 Windhagen,Linz, Fed. Rep. of Germany

[21] Appl. No.: 922,182

[22] Filed: Jul. 5, 1978

Related U.S. Application Data

[63] Continuation of Ser. No. 724,625, Sep. 20, 1976, abandoned.

[30] Foreign Application Priority Data

Sep. 23, 1975 [DE] Fed. Rep. of Germany ..... 2542294

[51] Int. Cl.[2] ..... E01C 23/12

[52] U.S. Cl. ..... 404/90; 404/95; 299/39; 37/13; 37/43 E

[58] Field of Search ..... 404/90, 91, 72, 77, 404/79, 110; 299/39, 91, 87, 79; 126/271.2 A; 37/13, 43 E, 43 C

[56] References Cited

U.S. PATENT DOCUMENTS

| | | | |
|---|---|---|---|
| 2,747,475 | 5/1956 | West | 404/95 X |
| 3,055,280 | 9/1962 | Neville | 404/95 |
| 3,361,042 | 1/1968 | Cutler | 404/90 X |
| 3,371,586 | 3/1968 | Nikolaev | 404/79 X |
| 3,598,027 | 8/1971 | Swisher | 404/90 |
| 3,732,023 | 5/1973 | Rank | 404/90 |
| 3,825,361 | 7/1974 | Steiner | 404/90 |
| 3,851,921 | 12/1974 | Makishima | 299/37 |
| 3,905,714 | 9/1975 | Perkins | 404/72 |
| 3,970,404 | 7/1976 | Benedetti | 404/77 |
| 3,975,055 | 8/1976 | Wirtgen | 299/39 |

*Primary Examiner*—Nile C. Byers, Jr.
*Attorney, Agent, or Firm*—John S. Roberts, Jr.

[57] ABSTRACT

The invention relates to a method for renewing road surfaces where in the course of one single operational step the road surface is milled away, heated and coated with new material and wherein according to a special embodiment of the invention the milling away or cutting away is performed to an amount not reaching the depth of the damages, at least part of the cut away material is distributed in the remaining recesses and is compressed, and subsequently the road surface is subjected to a heating and a subsequent aeration and is then uniformly coated with new material; and it relates also to a machine for performing the method, wherein, behind said cutting or milling device, a distribution device for distributing the milled off material in the remaining recesses of the road surface, a compression device for compressing the milled off material within the recesses, a heating device and optionally a scraper device provided for the aeration of the road surface, which are followed by a spreader device for applying the new coating to the road surface.

6 Claims, 3 Drawing Figures

DEVICE FOR RENEWING ROAD SURFACES

Figure 1:
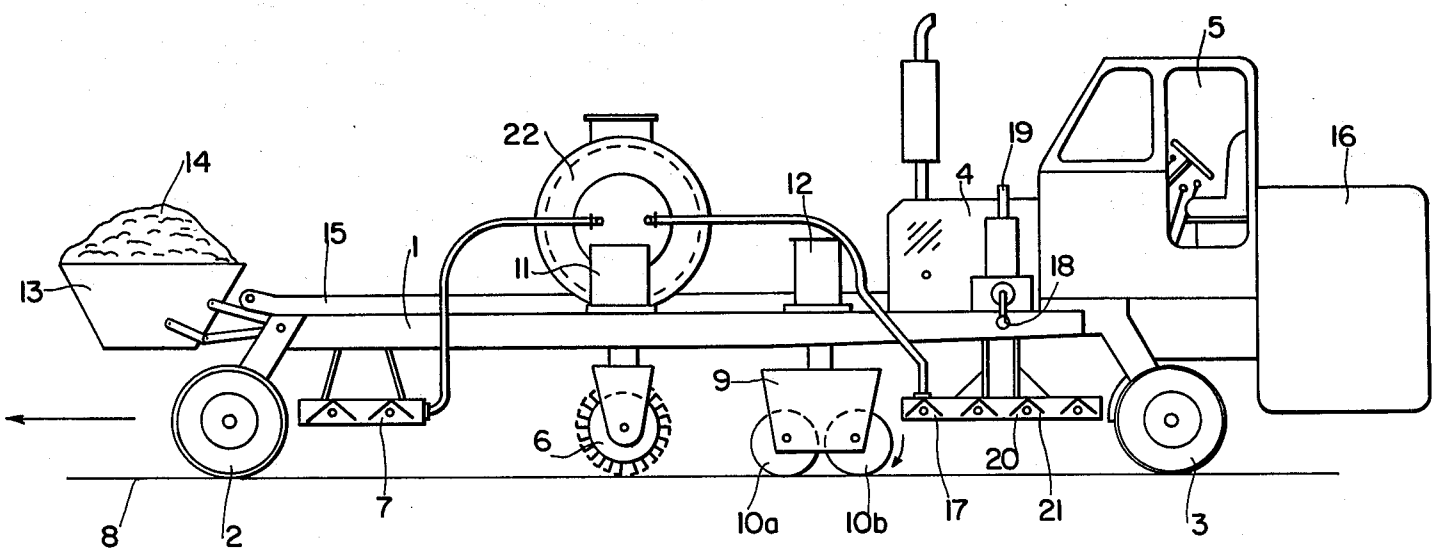

This is a continuation of application Ser. No 724,625, filed Sept. 20, 1976 now abandoned.

The invention relates to a method for renewing asphalt road surfaces wherein in the course of one single operational step the road surface to be renewed is cut or milled away, the road surface so treated is cleaned from the milled or cut off material, and subsequently the new surface material is applied, and to a machine for performing this method.

It has been known to renew asphalt road surfaces which have been damaged by either studded tyres or by atmospheric influence by cutting or milling away the surface thereof and subsequently, in the same operational step, spreading the milled away surface with the new material. Prior to the cutting or milling procedure, the road surface to be treated is generally heated in order to lower, on one side, the treatment time per road surface area unit and to decrease the wear of the cutting and milling tools, and to obtain, on the other side, an unobjectionable adhesion of the new coating on the cut away or milled away old coating. If the warm asphalt is applied, under pressure, on a heated old coating, a kind of "seal" will be obtained between the asphalt and the old coating. As has furthermore been found out, the adhesion of the new coating on the old one is the better, the cleaner the cut away or milled away surface. It is for this reason that of late the cut away or milled away surface is brushed away. Generally, this offers a great deal of difficulties, as by the heating of the road surface, which is to be cut or milled away, the cut away or milled away material clods together and sticks to the treated surface. Although this effect can be avoided by decreasing the heat, the desired seal between the coatings will then not be obtained as the temperature of the cut away or milled away old coating is too low. The latter will, by the way, also be the case if the coating to be removed is relatively thick as the amount of heat which is fed to the coating must in view of the danger of overheating remain under a certain limit value.

These difficulties and disadvantages will be overcome by the present invention. It is therefore one aim of the invention to provide a method by which an unobjectionable adhesion of the applied layer on the milled away or cut away road surface is guaranteed. The method can furthermore be performed with very little costs.

Starting from the method mentioned in the beginning, this problem is solved in accordance with the invention is that the cut away or milled away road surface is heated prior to the application of the new coating.

By this feature of the invention it is safeguarded that the temperature of the cut away or milled away old coating will, independently from the thickness of the removed layer, always have the level necessary for an unobjectionable "seal" between the new and the old layer. The treated old layer can furthermore be cleaned without any difficulties. The method can, moreover, be performed with very little costs involved as will be shown below. A particular advantage of the method according to the invention is seen in that a substantially smaller energy consumption per road surface area unit is necessary than in the case of prior art methods.

It is of advantage to heat the cut away or milled away road surface after the cleaning step. In this way, a particularly uniform heating of the treated road surface, and thereby a uniform adhesion between this surface and the new coating can be obtained.

It has furthermore shown to be of advantage if the cut away or milled away road surface is subjected to a depth heating. In this way, it is safeguarded that structural defects developed in the course of the cutting or milling of the road surface are cured when applying the new coating.

As is the case in the prior art method, the road surface can advantageously be heated, as an additional measure, prior to the milling or cutting step. For the heating, considerably less energy is generally used than in the prior art methods as the surface is heated only to the extent of the thickness to be cut away or milled away. In this case, where only such heating of the cut away or milled away old coating is provided, the energy consumption is considerably smaller than in the prior art method.

As the damages encountered on the road surface are very often relatively deep, large amounts of the road surface have to be milled away and on the other hand a correspondingly large amount of new road coating material has to be used for re-coating and preparation of the new surface layer.

The relatively large material exchange is very costly.

It is therefore a further object of the present invention to provide a new method wherein, on one hand, the road surface need be milled away for only a relatively small amount and wherein, on the other hand, for the re-coating with the new surface material only a correspondingly smaller thickness is necessary.

By performing extensive tests, Applicant has now developed a method for renewing damaged asphalt road surfaces wherein the costs for the milling away as well as for the re-coating can considerably be decreased and wherein only a fraction of the road surface that was hitherto milled away need be removed and wherein consequently only a fraction of the material needed for recoating is necessary.

The new method developed by Applicant for the solution of the problem of the invention is characterized in that the cutting away or the milling away of the damaged road surface is performed to an amount not reaching the depth of the damages, that at least part of the cut away material is distributed in the recesses and is compressed and that, subsequently, the road surface is subjected to a heating and a subsequent aeration, and is then uniformly coated with a new material.

By employing the process according to the invention, re-use of at least part of the cut away road surface material is made possible which is filled into the remaining grooves or damages in the road surface after the cutting process, is then compressed and subsequently heated. By so doing, this re-used road surface material combines, because of the bitumen contained therein, with the damaged road surface, and after subsequent aeration of the total road surface, the latter can be coated with the new material.

It has shown that while saving considerable costs, a road surface can be produced in that way which meets all the requirements and which excells in excellent durability and stability.

By re-using at least part of the milled away road surface material, the milled off material need not be transported away and on the other hand new material is saved to the same extent as the milled away material is re-employed.

It has proved to be sufficient when in practical operation 1 to 1.5 cm of the damaged road surface is milled away.

By filling and compressing the milled away material into the remaining grooves and damages of the road surface, it is made possible that the new surface material, finally used, is applied in an essentially uniform thickness so that the crumples of the new material usually encountered on locations where the latter is applied in a greater thickness are avoided in a simple way.

The above mentioned procedural steps of the method of the invention can be performed one after the other. It has however shown to be of particular advantage if these procedural steps of milling away, distributing the milled away material within the grooves, compressing, heating, aerating, and coating with the new material are performed in one procedural step. By so proceeding, the time necessary for the repair of the road surface is reduced to a minimum so that traffic is only little impaired by the repair of the road surface.

The method of the invention can on the other hand be performed in the most economic way and the demand for personnel can be kept very low.

In accordance with a further embodiment of the present invention it has shown to be of particular advantage if the cutting or milling away of the damaged road surface is preceded by a heating up step. In this way, the wear of the milling materials is substantially reduced and the operating speed can substantially be increased.

In accordance with a still further embodiment it has shown to be very suitable, particularly in those cases when a road surface having a relatively small bitumen portion is milled away, to mix prior to filling the milled away material into the remaining damages of the road surface, the latter material with preferably liquified bitumen. Such bitumen can be sprayed, when heated, on the milled away and pulverized material and will, in this way, encrease the adhesion of the material filled into, and compressed within, the recesses.

The invention relates furtheron to machines for performing the method of the invention.

Machines for cutting away or milling away road surfaces have already been known which comprise a chassis including at least three, but generally four, wheels at least one of which is steerable and driven via a drive shaft by a diesel engine. On the chassis, there is a cutting or milling device and behind it, in the direction of travel, there is provided a cleaning device which includes for instance ploughshares for the coarse material and rotary brushes for the fine-grained cut away or milled away material. At the rear end of the chassis, there is provided a spreader device which is connected via a conveyor belt to the front of the chassis where a bin to be filled, from a truck, with asphalt is provided.

The machine according to the invention starts from this prior art machine and differs from it in that between the cutting or milling device and the spreader device, a heating device is provided on the chassis.

In an embodiment of a particular further embodiment of the method, the heating device is suitably provided, in the direction of travel, behind the cleaning device. It has furtheron proved to be of advantage to provide the heating device immediately in front of the spreader device. Such an arrangement of the heating device has the advantage that, considering that the heating is immediately followed by the spreading of the treated road surface, a smaller amount of heat is needed than would be the case in a position more distant from the spreader device. This has not only a favorable effect on the current costs of the heating device but permits also a longer useful time of the machine between the times when the fuel tank has to be refilled.

In order to optimally adjust the heating device relative to the range of heat needed, i.e. to the intensity and the depth of the heating of the treated road surface, it is recommended to so provide the heating device on the chassis that it can vertically be adjusted. For the vertical adjustmust, there can be provided at least one hydraulic servomotor or, which can be advantageous with a view to the fact that the heating device need be adjusted in relatively rare cases only, at least one manually operated rack-and-pinion gear.

In a machine having a pre-heater, arranged in front of the cutting or milling device, to warm up the road surface to be cut away or milled away, the pre-heater and the heating device are suitably operated with the same fuel. It has proved to be particularly favorable for the current costs of the heating to use liquid gas as the fuel.

In a preferred embodiment of the invention, the fuel tank is provided on the chassis above the cutting or milling device. This has the advantage that the cutting or milling device is subjected to an additional high load which has a favorable effect on the uniform cutting or milling depth.

The heating device comprises suitably a number of parallel tubes provided with at least one succession of holes and arranged one after the other. The tubes are advantageously secured on a frame. Such a heating device is solid and can be manufactured without spending much money. Under certain conditions it may be of advantage to movably secure the frame to the chassis to obtain a further possibility of varying the course of the heat.

The invention relates furtheron to a machine of the kind described in the beginning which is characterized in that behind the cutting or milling device, a distribution device for distributing the milled off material in the remaining recesses, a compressing device for compressing the milled off material within the recesses, and a heating device are arranged which are followed by the spreader device for applying the new coating to the road surface.

A machine as described above includes suitably, between the heating device and the coating device, an additional scraping device which aerates the milled off road surface and the materials compressed in the recesses and thus adds to improve the adhesion between the road surface and the new coating applied.

In accordance with a further advantageous embodiment of the machine of the invention, there is provided, in front of the cutter roller, or the milling device, respectively, a heating device to heat the road surface which is to be milled away. Such heating device may for instance comprise a plurality of gas heated heaters fed from a liquid gas tank provided on the chassis.

The same liquid gas tank feeds also the second heating device provided immediately behind the compressors.

The compressor itself comprises suitably a vibration compressor and may, on one hand, cover the total width of the machine or may, in another embodiment of the present invention, be restricted to the damaged location, or locations, respectively. An eccentric compressor may be employed as well.

In accordance with a further embodiment of the present invention, the compressor device is provided in the form of a roller which compresses, by its weight, the material in the recesses.

Distribution of the milled off material in the remaining recesses is suitably performed by means of worm-shaped conveyor rollers which transport, at the same time, the excessive material to the side of the road where it is stored and can be removed by a second vehicle.

In accordance with a further advantageous embodiment of the present invention, it has shown to be suitable if the heating device which is provided in front of the coating device is vertically adjustable. In this way, the heating of the road surface prior to the coating can exactly be controlled.

The same applies to the scraper device provided behind the heating device which, in accordance with a further advantageous embodiment of the present invention, is vertically adjustable as well. In this way, aeration of the road surface prior to the application of the new surface material can be adapted to the requirements to obtain optimum adhesion between road surface and the new surface material applied.

Milling of the road surface is performed either with the aid of a cutter roller provided with chisels or by peeling cutters.

In the first case, that is when using a cutter roller, it has shown to be of advantage to provide at the two end supports of the cutter roller vertically adjustable supporting wheels with the aid of which it is possible to exactly adjust the cutting depth on one hand and to substantially exclude vibrations during the cutting process so that they will not affect the coating process at the rear end of the machine.

In accordance with a particularly advantageous embodiment of the present invention, a device, arranged after the cutting or milling device, for spraying or mixing the milled off material with preferably liquid bitumen is provided.

The bitumen, or the asphalt, respectively, is heated and liquified in a container which includes a heating device and is then sprayed with the aid of a generally built-in spraying device onto the milled off material.

The invention relates furtheron to a machine for renewing road surfaces of the kind described above which includes a novel storage bin having a relatively great capacity, which can easily be filled and particularly emptied and is so secured to the chassis that when it is emptied, if necessary, a nonuniform load of the machine is avoided, or can at least be substantially reduced.

In accordance with the invention, this problem is solved in that the storage bin is provided with support wheels and is secured to a horizontal, or about horizontal, axis on the chassis around which it can be tilted.

By these measures according to the invention it is safeguarded that the capacity of the storage bin can be selected relatively large, as it can be tilted, if not used, into a position wherein it does not disturbingly enlarge the overall dimensions of the machine. By the tilting connection of the storage bin to the chassis, residual amounts may be discharged from the storage bin which facilitates the cleaning of the storage bin quite substantially. By providing support wheels to the storage bin and pivoting the storage bin to the chassis, it is safeguarded that changes in the filling of the storage bin will not, or only slightly, change the overall load on the chassis. It is furthermore possible to additionally load, by tilting up the storage bin, the wheel pair neighboring the storage bin of the chassis, which is for instance desired if a hard, difficult-to-treat road surface has to be removed.

In one embodiment of the invention, the storage bin is pivoted immediately to the chassis. It is however more suitable to secure the storage bin to one end of a supporting arm which carries part of the conveyor device the other end of which is pivoted to the chassis. This has the advantage that the storage bin can particularly easily be charged and decharged. The portion of the conveyor device arranged within the supporting arm is suitably provided as a bellt conveyor. It is self-evident that a worm gear conveyor or any other conveying device ca be used as well.

For tilting the storage bin, a cable winch, an electromotor including a gear or, which is particularly suitable, at least one hydraulic servomotor can be employed. The advantage of the latter embodiment can be seen in that the hydraulic servomotor, or motors, respectively, can be connected to the existing hydraulic system, and no additional investments for a pressure means or current generator, respectively, are necessary. In a preferred embodiment there are provided on each side of the frame, which houses part of the conveyor device, a hydraulic operating cylinder each, one end of which is pivoted to the chassis while the other end thereof is secured to a point between the swivel axis and the storage bin. Such an embodiment constitutes a particularly space-saving structure of high mechanical strength.

The number of supporting wheels provided on the storage bin can almost freely be chosen. It has shown to be suitable to provide two supporting wheels. In a preferred embodiment, the supporting wheels are vertically adjustable. This offers the possibility to swivel the storage bin, via the hydraulic operating by cylinders provided on each side of the frame while adjusting at the same time the height of the supporting wheels to different positions without changing the load of the chassis. It has shown to be of advantage to adjust the supporting wheels by hydraulic means.

The invention will be explained in detail in the following based on the exemplified embodiments shown in the attached drawings.

Figure 2:
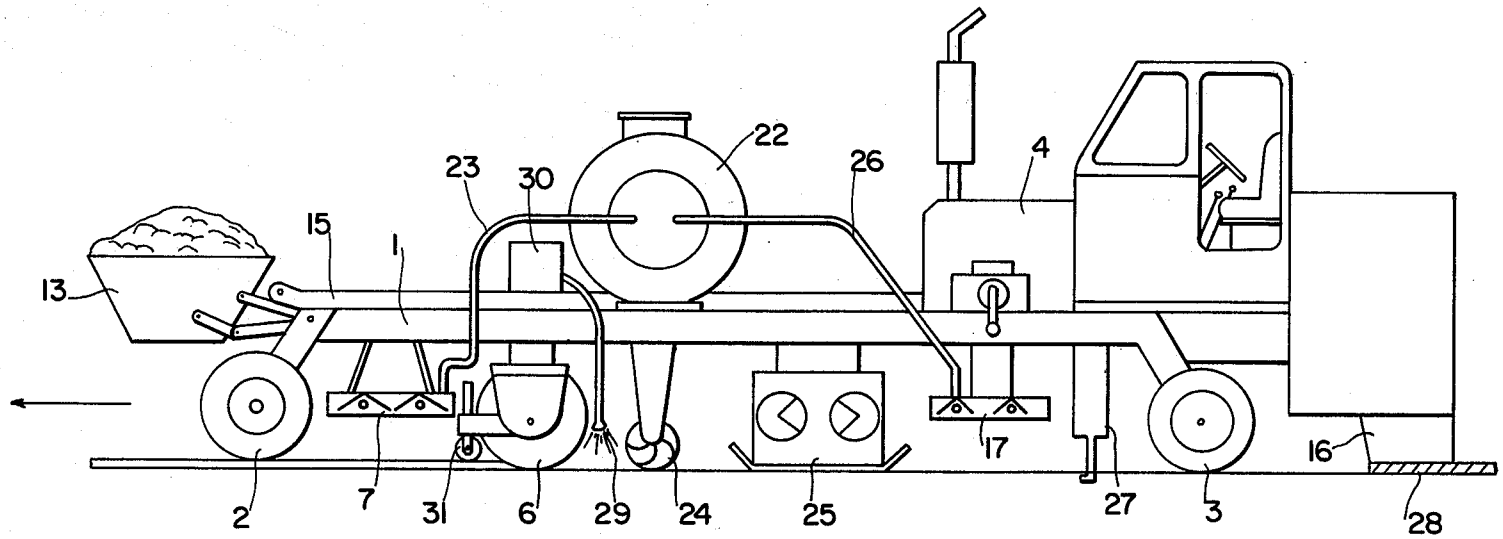
Figure 3:
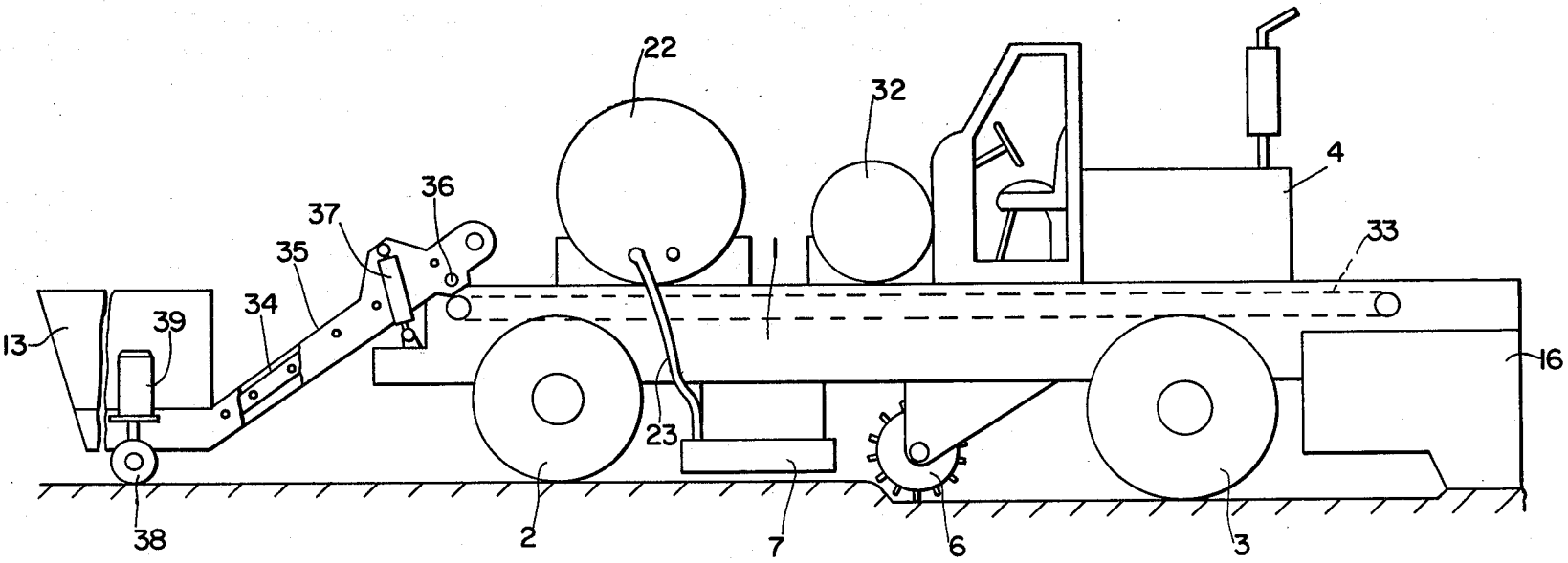

In the drawings,

FIG. 1 is a schematic side view of a machine for milling and re-coating wherein the road surface is heated prior to re-coating, FIG. 2 is a schematic side view of a machine for milling and re-coating wherein part of the milled off material can be re-employed, FIG. 3 is a schematic side view of a machine for milling and re-coating including a novel storage bin for the new material to be applied.

The machine depicted in a side view for cutting away and re-coating road surfaces comprises chassis 1 including steerable front wheel pair 2 and rear wheel pair 3, diesel engine 4 for driving said rear wheel pair 3, and driver's cabin 5.

Between the two wheel pairs 2 and 3, there is provided vertically adjustable cutter roller 6. In front of cutter roller 6, in the direction of travel, there is arranged pre-heater 7 to warm up road surface 8, and behind it, there is provided cleaning device 9 including worm conveyor 10*a* and rotary brush 10*b*. Cleaning device 9 is also vertically adjustable on chassis 1. In order to vertically adjust cutter roller 6 and cleaning device 9, two hydraulic servomotors each, 11 and 12, respectively, are used.

The front portion of chassis 1 includes bin 13 serving to hold coating material 14 to be used. Material 14 to be used is transported via belt conveyor 15 to the rear portion of chassis 1 to spreader device 16 not shown in detail.

In front of spreader device 16, in the direction of travel, heating device 17 is vertically adjustable on chassis 1. For the vertical adjustment, two rack-and-pinion gears 19 operated with the aid of a crank 18 are provided. Heating device 17 includes frame 20 secured to the movable parts of rack-and-pinion gears 19 and having a number of parallel and series-connected gas-heated infra-red heaters.

Pre-heater 7 as well as heating device 17 are operated by liquid gas which is stored in tank 22 arranged on chassis 1 above cutter roller 6.

In the machine shown in FIG. 2, cutter roller 6 is vertically adjustably provided on chassis 1 and pre-heater 7 is vertically adjustably secured in front of cutter roller 6, seen in the direction of travel, on chassis 1 and is operated, via duct 23, by liquid gas which is fed from fuel tank 22.

Behind cutter roller 6, as seen in the direction of travel, there is provided worm conveyor 24, by which the milled off material is transported into the remaining recesses in the road to be compressed and solidified in these recesses by compressor 25 arranged behind it.

A second heating device 17 vertically adjustably provided on chassis 1 and comprising gas heaters which are fed via duct 26 from liquid gas tank 22 as well, serves to heat the road surface.

Behind heating device 17, scraper device 27 is provided on chassis 1 which makes possible, by a corresponding height adjustment, that the solidified and heated road surface is aerated up to a desired depth before spreader device 16 provided on the chassis will apply the new surface layer 28.

The material for the new surface layer 28 is stored at the front end of the machine in a suitable bin 13 and is transported via a conveyor belt 15 running over chassis 1 to the spreader device 16 at the rear end of chassis 1.

Between cutter roller 6 and worm conveyor 24, there is provided a spraying device 29 by which the bitumen (or the asphalt), liquified in heatable container 30, is sprayed onto the milled off material in order to so improve the adhesion of this material to the road recesses.

Cutter roller 6 is provided on each side, at the end supports, with a vertically adjustable support wheel 31 each. These two support wheels permit an exact adjustment of the cutting depth, on one hand, and avoid the vibrations usually encountered in the cutting process, on the other, which would very easily be transferred to the spreader device, provided at the rear end of the machine, and would lead to a non-uniform, particularly wavelike layer.

The machine shown in FIG. 3 comprises chassis 1 including a driven and steerable front wheel pair 2 and a rear wheel pair 3. At the rear portion of the machine, there is drive motor 4, and the driver's cabin in front thereof. In front of the driver's cabin, fuel tank 32 for engine 4 is provided and in front thereof liquid gas tank 22 is arranged which is connected, via duct 23, to heating device 7 secured behind front wheel pair 2. Behind heating device 7, cutter roller 6 is arranged. At the rear end of the machine, spreader device 16 is provided which is connected via a conveyor device including two belt conveyors 33 and 34 to storage bin 14 provided in front of the machine.

Storage bin 14 is secured to one end of frame 35 the other end of which is secured, tiltingly around axis 36, to chassis 1. In order to tilt frame 35 in which the rollers of belt conveyor 34 are supported, there is provided a hydraulic operating cylinder 37 on each side of the frame connected at one end to chassis 1 and at the other to frame 35. Storage bin 14 bears via two wheels 38 on the road surface to be milled away. Each of the two support wheels 38 is vertically adjustable via a hydraulic operating cylinder 39 so that storage bin 14 can be adjusted, by actuating operating cylinder 37 and 39, in various positions in which it is still supported on the road surface but can also, by the actuation of operating cylinders 37 be adjusted to a position wherein the total weight is resting on the neighboring front wheel pair.

I claim:

1. An apparatus for repairing asphaltic road pavements in a combined operation comprising an elongated chassis having at least three wheels, at least one of which is steerable and at least one of which is drivable so that said chassis is supported for movement longitudinally along such a pavement, a series of longitudinally spaced processing units carried by such chassis and including means for heating the upper surface of such a pavement, behind said means for heating, a means for milling the thus heated upper surface to cut away the same to a depth less than that of at least some of the damaged areas of such pavement, behind said means for milling, a means for distributing at least some of such displaced material into the recesses of such damaged areas, means for compressing such distributed material, means at the rear end of said chassis for applying fresh asphaltic material to such heated exposed upper surface, and a tub-like storage bin provided at the front end of said chassis for the storage of the new coating material, wherein said storage bin is provided with supporting wheels and is pivotally mounted for movement about a horizontal axis on said chassis so that it can be tilted.

2. Apparatus according to claim 1, wherein said storage bin is directly pivoted to said chassis.

3. Apparatus according to claim 1, wherein said storage bin is secured to one end of a supporting arm the other end of which is pivoted to said chassis, and conveying means for conveying such fresh asphaltic material from said storage bin to the means for applying such fresh material including a conveying component carried by said supporting arm.

4. Apparatus according to claim 3, wherein on each side of said supporting arm a hydraulic operating cylinder is provided, one end of which is pivoted to said chassis while the other end is pivoted to a point between the swivel axis and said storage bin.

5. Apparatus according to claim 4, wherein two supporting wheels are provided supporting said storage bin.

6. Apparatus according to claim 5, wherein said supporting wheels are vertically adjustable.

* * * * *